US005678276A

United States Patent [19]

Ledingham et al.

[11] Patent Number: 5,678,276

[45] Date of Patent: Oct. 21, 1997

[54] PAINT BRUSH WITH BRISTLE CLAMPING PANELS

[76] Inventors: Blake A. Ledingham, 501 - 1200 West Pender Street, Vancouver, British Columbia, Canada, V6E 2S9; Terry R. Douglas, 7677 - 134th Street, Surrey, British Columbia, Canada, V3W 9E9

[21] Appl. No.: 419,275

[22] Filed: Apr. 10, 1995

Related U.S. Application Data

[63] Continuation-in-part of Ser. No. 168,510, Dec. 22, 1993, Pat. No. 5,435,037, which is a continuation-in-part of Ser. No. 968,771, Oct. 30, 1992, Pat. No. 5,289,606.

[51] Int. Cl.[6] ..... A46B 3/08

[52] U.S. Cl. ..... 15/168; 15/176.6; 15/177; 15/178; 15/193; 15/202; 15/204; 15/DIG. 4

[58] Field of Search ..... 15/146, 159.1, 15/168, 169, 171, 176.1, 176.4–176.6, 177, 178, 191.1, 192–194, 202, 204, 205, DIG. 4

[56] References Cited

U.S. PATENT DOCUMENTS

| | | | |
|---|---|---|---|
| 134,745 | 1/1873 | Gorman | 15/177 |
| 613,671 | 11/1898 | Fitts | 15/178 |
| 683,007 | 9/1901 | Walker | 15/204 |
| 911,466 | 2/1909 | Wilkins | 15/178 |
| 1,033,272 | 7/1912 | Rowe | 15/194 |
| 1,161,308 | 11/1915 | Hack | 15/178 |
| 1,285,195 | 11/1918 | Iker | 15/178 |
| 1,358,369 | 11/1920 | Forester | 15/178 |
| 4,129,918 | 12/1978 | Lee | 15/169 |
| 4,237,579 | 12/1980 | Salmon | 15/166 |
| 4,339,837 | 7/1982 | Reeberg | 15/169 |
| 5,289,606 | 3/1994 | Ledingham | 15/168 |
| 5,435,037 | 7/1995 | Ledingham | 15/168 |

FOREIGN PATENT DOCUMENTS

| | | | |
|---|---|---|---|
| 1177 | 3/1877 | Canada | 15/204 |
| 86543 | 9/1920 | Switzerland | 15/178 |
| 6294 | 3/1905 | United Kingdom | 15/204 |
| 606536 | 8/1948 | United Kingdom | 15/202 |
| 688287 | 3/1953 | United Kingdom | 15/204 |

*Primary Examiner*—Mark Spisich
*Attorney, Agent, or Firm*—Oyen Wiggs Green & Mutala

[57] ABSTRACT

This invention pertains to paint brush with bristle clamping panels. The paint brush can be fabricated easily and inexpensively, is easy to use, and provides ready cleaning after use, by releasing the panels and exposing the bristles to the cleaning solution. A paint brush comprising: (a) a paint brush body and handle, the body having formed in one end thereof a cavity for receiving a group of bristles; (b) a pair of pivotal members secured to respective sides of the body, and projecting over the cavity, the pivotal members being capable of abutting bristles when moved to a first closed position, and being remote from such bristles when moved to a second open position; (c) a securing member positioned on the body for securing the pivotal members in a first position and releasing the pivotal members for movement to a second open position.

8 Claims, 9 Drawing Sheets

PAINT BRUSH WITH BRISTLE CLAMPING PANELS

This application is a continuation in part of application Ser. No. 08/168,510, filed 22 Dec. 1993, now U.S. Pat. No. 5,435,037, which is a continuation in part of application Ser. No. 07/968,771, filed 30 Oct. 1992, now U.S. Pat. No. 5,289,606, and adds and claims additional disclosure not presented in the prior applications.

FIELD OF THE INVENTION

This invention pertains to paint brush with moveable bristle clamping panels which, when in a closed position, prevent paint from migrating up the bristles. The paint brush can be fabricated easily and inexpensively, is easy to use, and provides ready cleaning after use, by releasing the panels and exposing the bristles to the cleaning solution.

BACKGROUND OF THE INVENTION

A longstanding problem with paint brushes that are used for industrial and domestic painting applications is that with time and repeated use, paint tends to build up within the bristles of the brush in the region where the bristles are held by the ferrule clamp that joins the bristles with the paint brush handle and base. The collected paint in this confined area is difficult to clean away. Usually, some residual paint is left in the bristles at the junction with the ferrule even after the used brush has been cleaned. The dried paint at this location collects and builds up over time with repeated use of the paint brush. This causes the bristles of the brush to spread and thereby reduces the efficiency of the brush. Also, the build up of dried paint tends to cause the bristles to wear and break at the location of the dried paint. This reduces the life of the paint brush.

Proper cleaning of a paint brush requires a considerable amount of solvent, if the person cleaning the brush is meticulous. If the paint has a water base, this is also a serious problem because large amounts of water are wasted attempting to thoroughly clean the brush. However, if the paint is an oil base paint, then expensive petroleum paint solvent or thinner is required for cleaning. The use of a petroleum base solvent constitutes a waste of costly solvent and at the same time creates an environmental pollutant. Most commercial painters will tend to minimize costs by balancing the amount of the solvent used with the number of times the paint brush is used. It may be economic, for instance, to only expect a paint brush to be used a half-dozen times before it must be discarded, rather than incur the cost and waste a considerable amount of solvent attempting to meticulously clean the brush after each use, and prolong the life of the paint brush.

It would be advantageous if a paint brush could be designed which would minimize or eliminate the build up of paint in the location where the bristles are set or meet the paint brush handle. It would also be useful if a mechanism could be developed to reduce the amount of solvent which is required to clean a paint brush. It would also be beneficial if a mechanism could be developed which would reduce or eliminate bristle flare as it occurs over time when a paint brush is repeatedly used.

U.S. Pat. No. 5,289,606, issued Mar. 1, 1994, to Blake A. Ledingham, discloses a unitary paint brush which comprises a paint brush body attached to a handle. The body defines a cavity adapted for receiving a group of bristles. A pair of hinged releasable flaps project over the cavity to abut the bristles when moved to a closed position. The bristles are released by moving the flaps into an open position. The hinged flaps are held in place on the bristle pack base by springs which can be rotated from a flap open position to a flap closed position, and vice versa. A problem with the springs is that they are a separate component and raise manufacturing expense.

U.S. Pat. No. 4,129,918, granted Dec. 19, 1978, to Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, issued Dec. 9, 1980, to Jonathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, granted Jul. 20, 1982, to Christiaan Reeberg, discloses a sliding box-like girdle which fits over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

SUMMARY OF THE INVENTION

The invention is directed to a paint brush comprising: (a) a paint brush body and handle, the body having formed in one end thereof a cavity for receiving a group of bristles; and (b) at least one moveable member secured to a side of the body, and projecting over the cavity, the moveable member being capable of abutting the sides of the bristles when moved to a first bristle abutting position, thereby creating a paint stop line on the bristles, and being remote from such bristles when moved to a second open position.

The paint brush can include a securing means for securing the moveable member in a first position and releasing the member for movement to a second open position. Two moveable members can be included.

The paint brush can include a second securing means positioned on the moveable member for cooperating with the first securing means for securing the two moveable members in a first position and releasing the two moveable members for movement to a second open position. The paint brush can include a group of bristles secured within the cavity.

The pair of moveable members can be elongated planar panels, and can be respectively moveable along a line on each side to the body, adjacent the cavity. The free edges of the panels removed from the sides of the panels that are connected to the body can have reinforcing clips secured to the free ends of the panels.

The first securing means can be projections on the members which can fit in depressions on the body. The second securing means can be projections which can mate with the first securing means when the panels are closed against the bristles by having the projections and depressions interact and when the panels are moved to a second open position, the projections and depressions can disengage and enable the panels to be moved away from the bristles.

The first securing means can be projections on the ends of the pair of panels, and the second securing means can be depressions which mate with the first securing means when the panels are closed against the bristles by having the depressions and projections interact and when the panels are moved to a second open position, the depressions and projections can disengage and enable the panels to be moved away from the bristles.

The paint brush can include a removable bristle separator located in a cavity between the pair of releasable members. The separator can have a uniform, or tapered cross-sectional thickness or a thickened mid-section.

The paint brush can include glue which secures the bristles together, the glue and adjacent bristles fitting in the interior of the cavity. The bristles can be arranged in a pack which can be removable from the paint brush by releasing the moveable member. The removable bristle separator can be secured to end walls of the cavity between the respective releasable members.

The projections can be semi-spherical knobs on the ends of the panels and the depressions can be semispherical hollows in the end flaps adjacent the positions of the knobs when the side panels are in a closed position.

The securing means can be a slidable ring which can fit around the circumference of the body and slide over the panel to hold the side panel in a closed position, and slide away from the side panel to enable the side panel to be moved to an open position. The ring can have a releasable securing means which can cooperate with the body to hold the ring in a panel closed first position or a panel open position.

The invention is also directed to a bristle holder for use with a paint brush handle and base with a handle at a first end and a base at the second end, the bristles having a base abutting the second end, comprising: (a) a girdle adapted to encircle the base of the paint brush handle and the base of the bristles; and (b) a pair of moveable members secured to each side of the girdle, on the end of the girdle removed from the handle, the members being capable of abutting the bristles when moved to a first closed position, creating a paint stop line on the bristles, and being removed from the bristles when moved to a second open position.

The paint brush can include a releasable securing means for securing the moveable members in a closed position against the bristles and releasing the members for movement to an open position.

The member of the holder can be movably connected to the girdle and can have thereon an internal ridge which can bear on the bristles when the member is in a bristle abutting position. The hinged members can be panels held in position against the bristles by a projection and corresponding mating recess combination.

The projections can be located on the panels and the recesses can be on the girdle, the projections abutting and mating with the recesses when the panels are in a closed position.

The securing means can be a ring which can slidably fit around the girdle, the ring fitting over and abutting the panels when in a closed position, and fitting over the girdle when the panels are in an open position.

The holder can have a rectangular configuration, the pair of panels extending along the longitudinal sides of the rectangular girdle, and the panel securing ring can have a releasable ring holding member which cooperates with the surface of the girdle and hold the ring in a panel open position or a panel closed position.

The separator can have thin ends with a thickened mid-section, or be planar with a uniform cross-section or can have a tapered thickness extending from an end which is adjacent the paint brush handle to the end which is adjacent the end of the girdle.

The invention is also directed to a unitary paint brush with replaceable bristles comprising: (a) a paint brush body and handle, the body having formed in one end thereof opposite the handle a cavity adapted for removably receiving a first end of a group of parallel bristles the second end of the bristles projecting from the cavity; (b) at least one releasable member with a first free end and a second end secured to the paint brush body, with the free end projecting over the cavity, the free end of the releasable member being capable of abutting the bristles at a mid-point between the first and second ends of the bristles when moved to a first closed position, to thereby establish a paint stop location on the bristles and being removed from the mid-point of the bristles when moved to a second open position; (c) a group of bristles held together in parallel with one first end located within the cavity of the holder, and held in place by the first free end of the releasable member when in a first closed position, the second end of the bristle group extending from the cavity, said bristle group being removable from the cavity when the releasable member is moved to a second open position.

DRAWINGS

In the drawings which represent a detailed illustration of specific embodiments of the invention, but which should not be construed as limiting the scope of the invention in any way:

DETAILED DESCRIPTION OF A SPECIFIC EMBODIMENT OF THE INVENTION

Unlike conventional paint brushes, which typically are constructed of a wooden handle, a ferrule, a bristle separating member, nails, and bristles, the main components of the subject paint brush bristle holder are formed primarily of three pieces, a handle, a bristle girdle and a removable bristle pack.

Figure 1:
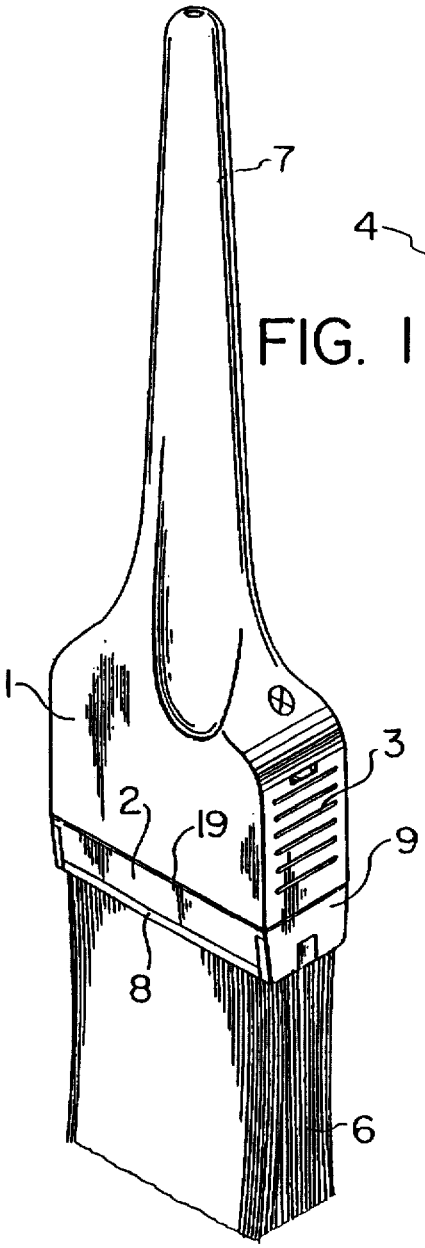
FIG. 1 illustrates an isometric view of a paint brush with disengageable bristle clamping panels.

FIG. 1 illustrates an isometric view of the paint brush comprising handle, girdle base and bristle pack. The handle 7 is usually formed of wood and melds smoothly with the plastic girdle base or ferrule 1, which is typically formed from injection molded polypropylene or polyethylene. The girdle base 1 has on each longitudinal side thereof, at the end opposite the handle 7, a pair of semi-rigid moveable bristle compressing side panels 2. Optional ergonomic finger grips 3 are located on each narrow lateral side of the base 1. The side panels 2 have inherent resilience and normally exert a certain amount of inward force on the bristles 6, which thereby squeezes the bristles and creates a paint stop line which prevents wet paint on the free end of the bristles from migrating past the free edges of the panels 2.

The panels 2 may also be held in place by optional projections (not visible in FIG. 1) which, in a closed position, assist in holding the panels 2 against the bristles 6. The optional projections fit in appropriate mating receptacles in the end flaps 9 and are released by pulling the free ends of the panels 2 outwardly away from the bristles 6. The resilient movement resisting movement or bend line for the side panel 2 is indicated by line 19. The free edges of the two hinged panels 2 can optionally be reinforced with respective stainless steel U clips 8, which provide dimensional linear stability to the edge of the side panels 2, thereby resisting bending and distortion when the side panels 2 are closed against the bristles 6. The inner edges of the clips 8 apply a consistent uniform inward squeezing force across the width of the bristles, to create a paint stop line on the bristles. End flaps 9 are located below the finger grips 3, on the narrow lateral sides opposite the handle 7 and are positioned between the ends of the opposed side panels 2.

Figure 2:
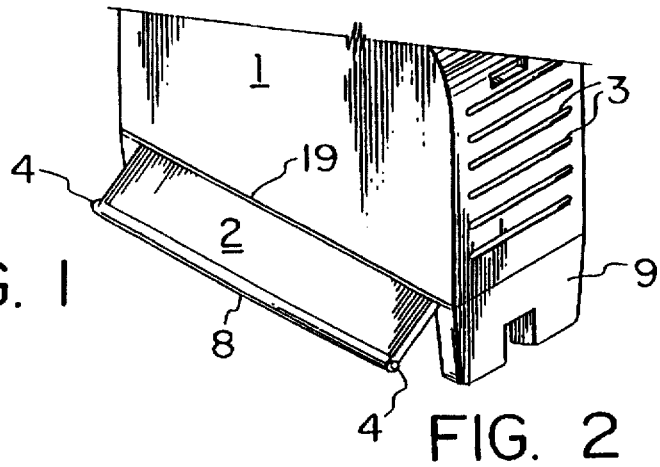
FIG. 2 illustrates a detailed isometric view of a portion of one of the clamping panels and ferrule of the paint brush.

FIG. 2 illustrates an isometric side view of the ferrule base 1 and side panel 2 of the paint brush. As seen in FIG. 2, side panel 2 has been pulled upwardly away from end flap 9, and the bristles (not shown), along resilient line 19. In this position, the removable bristle pack 6 can be withdrawn for cleaning or replacement. FIG. 2 also shows the optional end projection or knob 4 which is adapted to be received in a depression 5 (shown in FIG. 4) in end flap 9, which will be discussed in more detail below.

Figure 3:
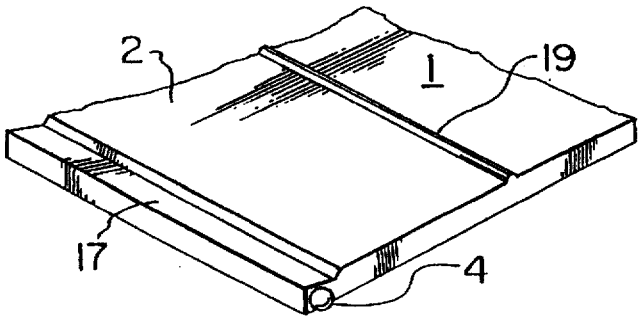
FIG. 3 illustrates a detailed isometric view of one of the clamping panels of the paint brush.

FIG. 3 illustrates an isometric detailed view of the corner of the panel 2, bend line 19 and body 1 combination. The free end of the panel 2, at the edge away from the bend line 19, has formed therein along its length a clip depression 17, which is adapted to receive the reinforcing U clip 8 (see FIG. 1). The corner of the panel 2 has thereon an optional holding projection or knob 4, which is adapted to fit into a corresponding depression 5.

Figure 4:
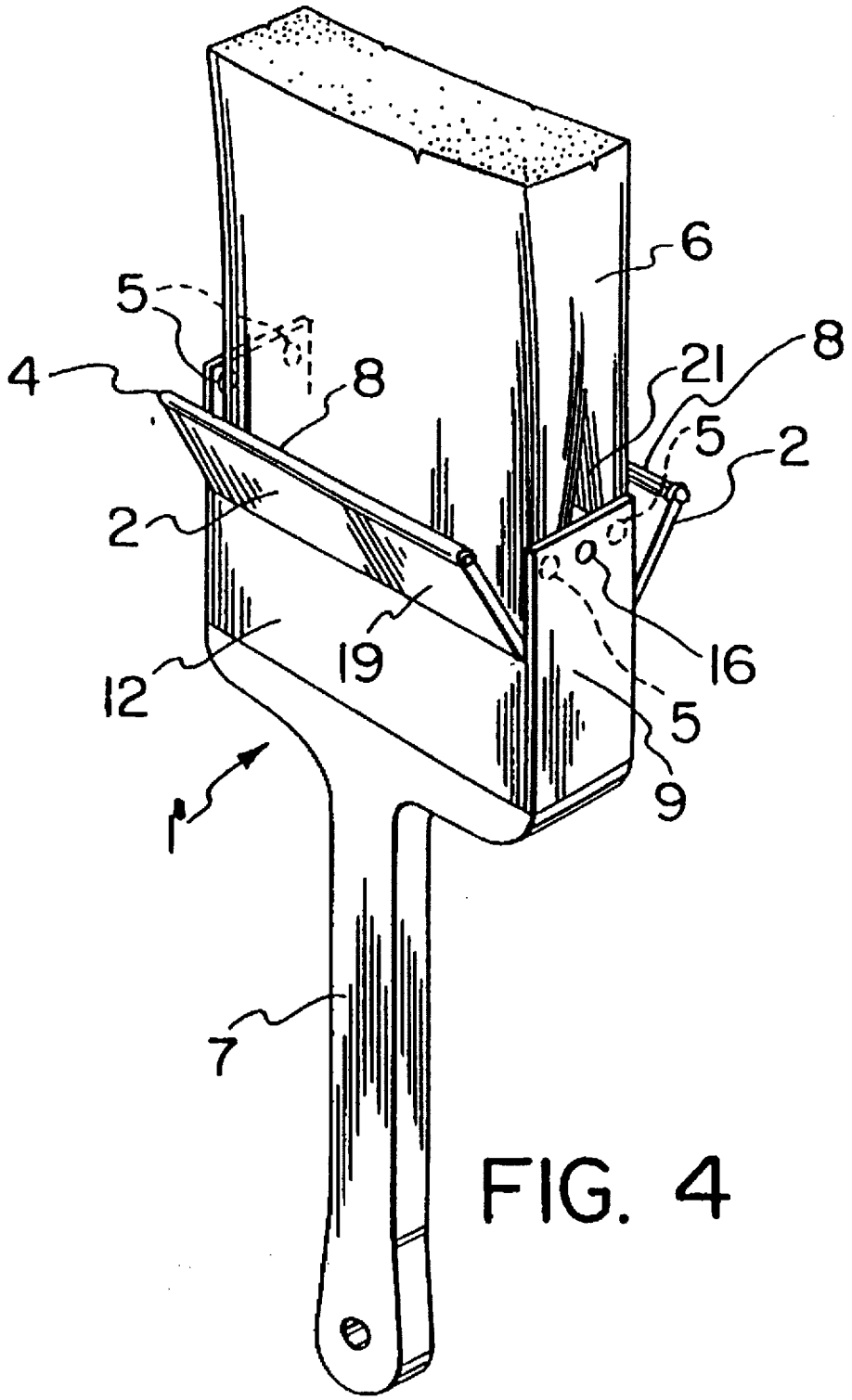
FIG. 4 illustrates an isometric view of an alternative embodiment of the paint brush bristle holder installed on the handle of a paint brush.
Figure 5:
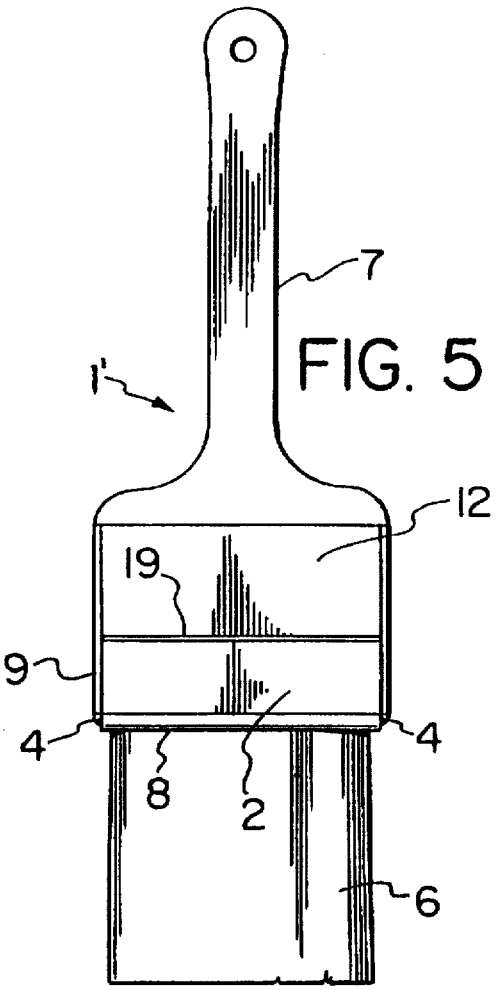
FIG. 5 illustrates a side view of a paint brush with the bristle holder.
Figure 6:
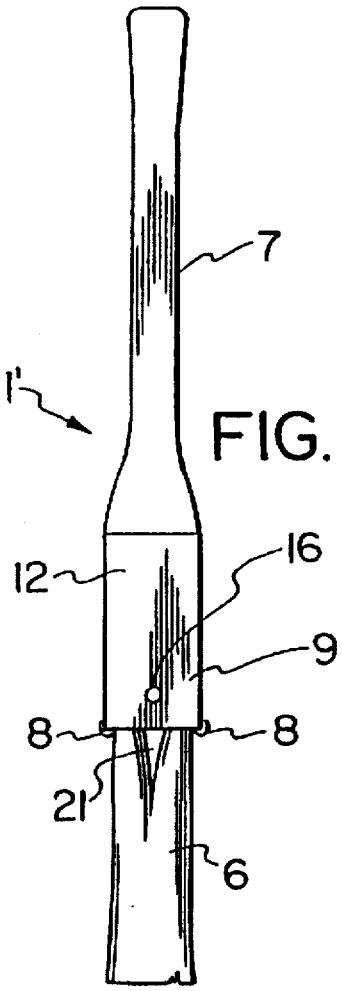
FIG. 6 illustrates an end view of the bristle holder with the side gripping panels closed against the bristles.

FIG. 4 illustrates an isometric view of a second embodiment of a paint brush 1' with handle 7 and removable bristles 6, equipped with a bristle holder base 12. In this embodiment, the holder 12 is formed separately from the handle 7 and is adapted to fit over the bristle end of a paint brush handle 7. The bristle holder 12 has on each side a bend-away side panel 2, which extends laterally along the wide side of the holder 12 and when in a closed position against the bristles 6 exerts an inward force on the bristles 6 to create a paint "stop-line" on the mid-point of the bristle 6. The closed panels 2 hold the removable bristle pack 6 in position within the holder 12. The edge of each resilient side panel 2, removed from the bristles 6, has thereon a respective reinforcing clip 8. The reinforcing clip 8 is usually formed of stainless steel and serves to provide linear dimensional stability to the bend away panel 2 when the panel 2 is pulled outwardly (as seen in FIG. 4) away from the bristles 6 so that it does not abut the bristle 6. (FIGS. 5 and 6 show the side panel 2 abutting the bristles 6.) The bristle holder 12 has on the free ends of the two panels 2 two optional securing projections 4 (which in FIG. 4 are shown on the respective ends of the laterally extending panels 2) which enable the panels 2 to be detached from the closed position and moved away from the bristles 6 for ready access to and cleaning of the bristles 6. The projections 4 fit into respective recesses 5 shown in dotted lines in FIG. 4. If desired, cleaning can be facilitated by removing the bristle pack 6 from the holder 12. A screw 16 fits in the narrow side of the holder 12, in end panel 9, and holds a bristle separator 20 (not visible in FIG. 4) which extends laterally across the interior of the holder 12 and separates the bristles 6 into two groups at the holder end of the bristles. The bristle separator 20 forms a space 21 between one group of bristles on one side of the holder 12 and another group of bristles on the other side of the holder 12.

FIG. 4 demonstrates how the inside ridge formed by the inside of clip 8 provides at the mid-point of the bristles 6 a strong bearing force "paint stop line" when the panels 2 are clamped against the bristle 6. When the panel 2 is closed against the bristle 6, the ridge exerts a localized force on the bristles 6 and prevents migration of the wet paint along the bristles 6 past the paint stop line.

FIG. 5 illustrates a front view of the paint brush 1', with handle 7 and bristles 6. As seen in FIG. 5, side panel 2 on the visible side of the brush 1' abuts the bristles 6, and besides its inherent resilient action, is held in place by the optional pair of projections or knobs 4 (shown in dotted lines) which are at each end of the panel and which have been snugged into position in corresponding depressions 5 (not shown) to assist in holding the side panel 2 against the bristles 6, and apply an inward paint migration retarding force (paint stop line) on the mid-point of the bristles 6. FIG. 5 also illustrates the optional reinforcing U-clip 8, constructed of hardened steel, which strengthens the edge of the side panel 2 and due to its ridge type configuration, ensures that a firm consistent bearing force is applied against the bristles 6 along the entire edge of the side panel 2. This creates the paint stop line at a mid-point on the bristles 6 and prevents the migration of wet paint along the bristles 6 from the free end of the bristles into the holder 12. FIG. 5 also illustrates holder end flap 9, which extends downwardly along the narrow side on opposite sides of holder 12.

It has been found that when the bristles 6 are contacted with paint for a time, particularly if they are natural bristles such as pig bristles, they tend to swell from absorbed water or solvent and create an outward force on the side panels 2. In order to create a strong inward resisting force on the bristles 6, therefore, it is important that the side panels 2 are formed of a strong resilient material which resists the bristle swelling action, and continues to create a strong inward squeezing force on the bristles 6, thereby creating the "paint stop-line" which prevents migration of wet paint along the bristles 6, due to capillary action. Then, when the brush requires cleaning, the two panels 2 are pulled away from the bristles to expose the paint stop-line for cleaning. If desired, the bristle pack 6 can be removed to facilitate cleaning further.

FIG. 6 illustrates an end view of the paint brush 1', with handle 7 and bristles 6. As also seen previously in FIG. 5, FIG. 6 illustrates the pair of side panels 2 in their normal closed position so that they abut the bristles 6 and provide an inward bristle squeezing action to create the "paint stop-line" on the mid-point of the bristles. If the squeezing action needs to be secured, the panels 2 can be held in place by optional securing projections or knobs 4 held in depressions 5 (not shown in FIG. 6). Screw 16, which extends the length of holder 12, holds the two ends of the holder together, as well as bristle separator 20, which is not visible in FIG. 6. The bristle separator 20 creates a space 21 between one base part of the group of bristles 6 and the opposite group of bristles 6 immediately adjacent the holder 12. This space 21 enables the paint brush 1' to hold more paint, so dipping into the paint of a paint can or tray is less frequent.

Figure 7:
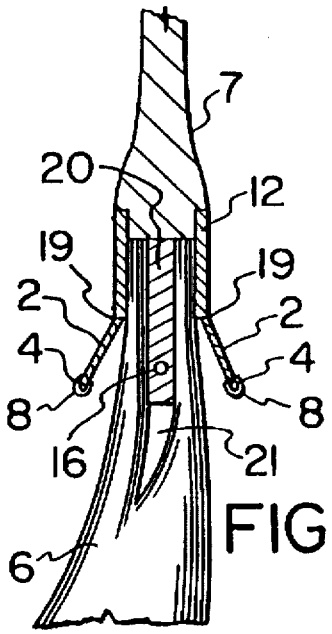
FIG. 7 illustrates an end section view of the bristle holder with the side gripping panels hinged away from the bristles.

FIG. 7 illustrates a side section view of the paint brush showing how the removable bristles 6 are arranged in two groups at the base and fit into the interior cavity of holder 12. As seen in FIG. 7, the pair of hinged side panels 2 are pulled away from the bristles 6 along bend lines 19. Bristle separator 20, which is held in place by screw 16, separates the bristles into two groups at the base, leaving space 21 between the two groups of bristles 6 below separator 20. As seen in FIG. 7, the optional knobs 4 on panels 2 have been pulled free of the respective depressions 5 and the relatively stiff side panels 2 have been pulled away from the bristles 6.

The orientation shown in FIG. 7 is ideal for exposing the "paint stop-line" on a mid-point of the bristles 6 and enabling the paint clogged bristles to be fully cleaned with solvent after the brush has been used. The bristles 6 can be completely removed as a bristle pack if desired. This facilitates cleaning further. By pulling the two hinged side panels 2 away from the bristles 6, bristle areas which have not been coated with paint, as well as those areas which have been exposed to paint (the intersection between the two areas is called the paint stop-line), are exposed to the solvent. This improves the ability of the solvent to dissolve the paint by exposing all of the paint area to the solvent. Unlike conventional paint brushes, there is no ferrule edge abutting the top end of the paint to interfere with cleaning. The solvent can be either a petroleum distilled solvent, typically used for removing oil base paint, or water, which is typically used to remove latex-base paint.

The bristle pack 6 can be of two basic designs (a) Cleanable Bristle Pack

The cleanable bristle pack has a longer bristle, thereby creating a "neutral bristle" area between the "pressure point" of the various bristle releasable members closed on the bristles and the "glued or bonded" end of the bristles inside the ferrule. This neutral bristle area can be of varying length, depending upon the type and length of bristle used and the type of paint recommended for that bristle.

(b) Replaceable Bristle Pack

This pack has a shorter bristle thereby eliminating the "neutral bristle" area. The "pressure point" or "paint stop-line" is directly on top of the "glued or bonded" end of the bristles. The reason for this type of bristle pack is to deal with situations where the paint, or an equivalent coating, being applied is extremely coarse, or environmentally unfriendly. Cleaning this type of paint could require use of a more undesirable, environmentally unfriendly solvent for clean-up, thereby creating more unwanted waste. Discarding a replaceable type bristle pack with extremely coarse paint would cause less waste in this case than if it were cleaned.

Figure 8:
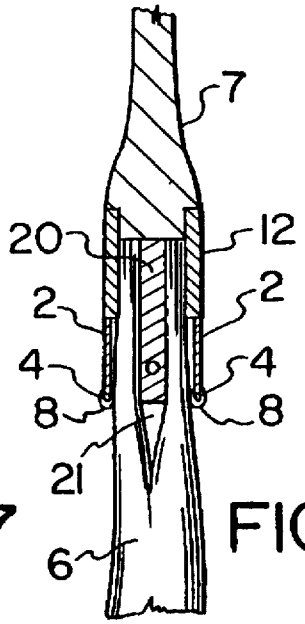
FIG. 8 illustrates an end section view of the bristle holder with the side gripping panels clamped against the bristles.

FIG. 8 illustrates a side section view of the interior of the brush, with the two side panels 2 abutting the respective sides of the bristles 6. The pair of reinforcing clips 8, with the internal ridge construction, ensure that the two side panels 2, when abutting the sides of the bristles 6, squeeze the bristles 6 together and thereby apply a localized force tightly against bristle separator 20, thereby creating the paint stop line and discouraging paint collected by the free end of the bristles 6 (upwardly as seen in FIG. 8) from migrating by capillary and liquid-flow action along the bristles 6 past the bristle contact point where the pair of reinforcing clips 8 abut the bristles 6. The stiff resilient nature of the side panels 2 resists swelling of the bristles 6 due to solvent absorption and continues to apply a compression force on both sides of the bristles. The combination of the reinforcing clips 8, with their ridge-like localized pressure point structure, and the bristle separator 20, also serve to hold the two groups of bristles firmly for painting purposes. Then, once the paint job has been completed, or the painter wishes to stop painting for the day, the painter merely pulls the pair of side panels 2 away from the bristles 6, and if present, disengage the optional knobs 4 from the respective depressions 5, to the position seen in FIG. 7, and the bristles 6 are then fully exposed for ready cleaning. If need be, the removable bristles 6 can be completely removed from the cavity in the holder base 12 of the brush (see, for example, FIG. 13) to facilitate the cleaning procedure.

Bristle holder 12, side panels 2 and holder end flaps 9 can be formed of a suitable resilient plastic such as medium density polyethylene, polypropylene, or some other flexible but semi-rigid plastic. The bend line 19 thickness between the panels 2 and the bristle holder 12, using such plastic materials, can be varied as required to regulate the required panel stiffness and can be flexed millions of times. Therefore a separate bend or hinge mechanism is not required.

Figure 9:
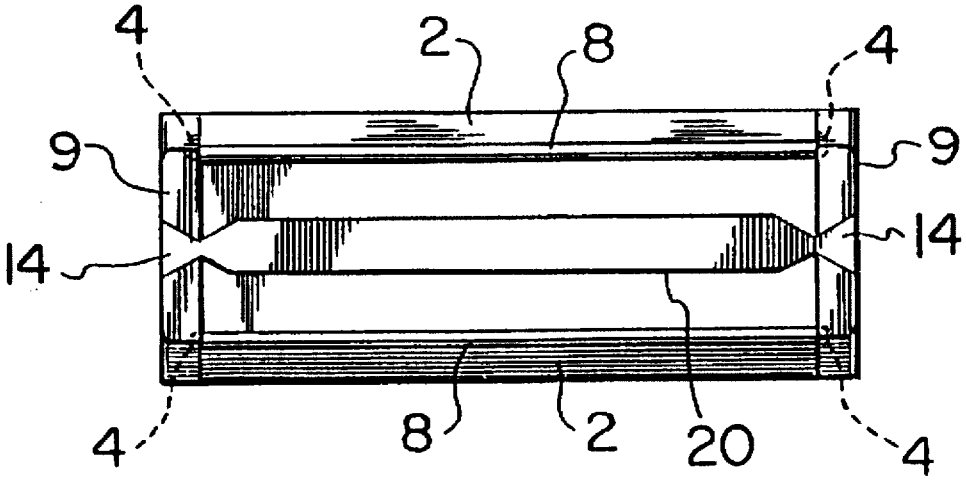
FIG. 9 illustrates a bottom view of the bristle holder without bristles.

FIG. 9 illustrates a bottom or end view of an embodiment of the paint brush and bristle holder, where the bristles have been removed. The pair of reinforcing U clips 8 extend along each longitudinal side of the side panels 2. As seen in FIG. 9, the panels 2 and clips 8 are in a bristle abutting position, which creates the "paint stop-line", with the optional projections or knobs 4 snapped into respective depressions 5 to provide closed positions. End flaps 9 extend along each narrow lateral side of the bristle holder. Located between the two side panels 2 and clips 8, at mid-point, and parallel therewith, is a removable separator 20. In the optional embodiment shown in FIG. 9, separator 20 is formed to have at each end a pair of wedge-shaped ends 14, which fit within the respective wedge-shaped openings in the ends of respective end flaps 9. While not shown, the bristles 6 are mounted in two groups in the spaces formed between separator 20 and the adjacent parallel flaps 2 and clips 8.

Figure 10:
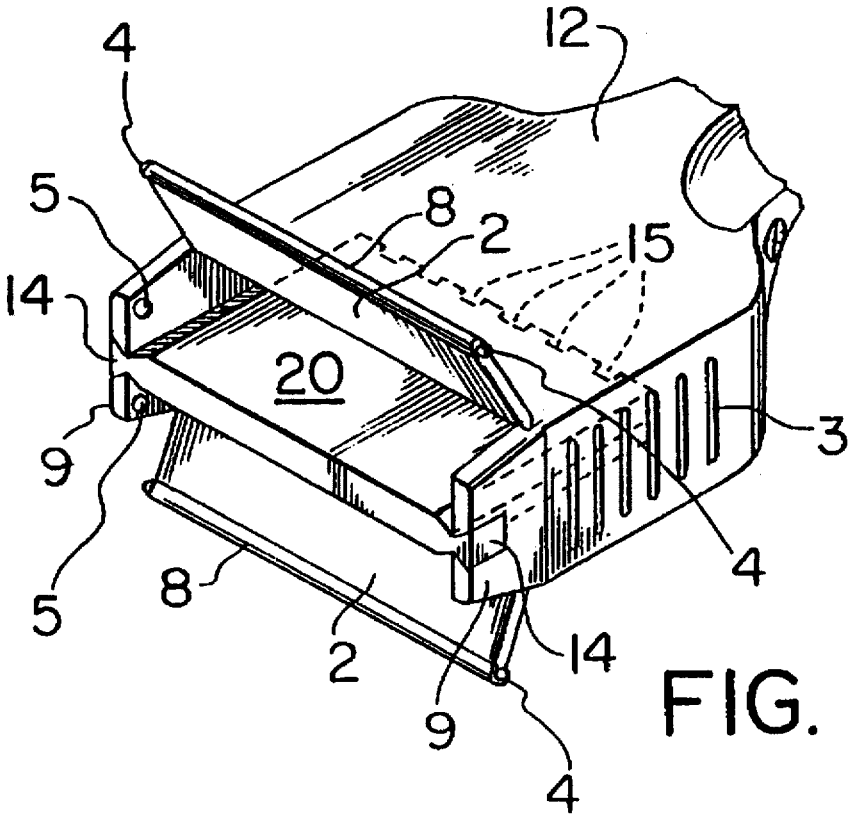
FIG. 10 illustrates an isometric view of the bristle holder without bristles and with the side bristle gripping panels in an open position.

FIG. 10 illustrates an isometric view of the end of the unitary paint brush and bristle holder 12, before the bristles are installed in the two spaces formed between the pair of flaps 2, part of the body 1', and the separator 20, to create a removable unit. As seen in FIG. 10, the pair of side panels 2 with U-clips 8 have been drawn away from the respective end flaps 9 along bend line 19. Separator 20 can be seen mounted in place end flaps 9, and held in place by respective wedges 14. Optional finger grips 3 are also shown on the one visible narrow lateral side of the body 1'. In the positive illustrated in FIG. 10, the paint brush bristle holder 12 is adapted to receive the insertion of two bunches of bristles 6 (not shown) in the respective openings existing between the central separator 20 and the exterior adjacent side panels 2, and the interior of holder 12, formed on either side of separator 20. The bristles can be either glued in place by injecting glue into the interior of the body base (thereby creating non-removable bristles), or the bristles can be in the form of an optional removable bristle pack where the bristles are pre-glued at one end and the set glue and bristles are held in place by side panels 2 to form the removable bristle pack embodiment. A series of openings 15 (shown in dotted lines) are formed in the interior edge of the separator 20 adjacent the body 1'. These openings 15 permit glue to pass from one side of separator 20 to the other side, thereby ensuring consistent and uniform gluing of the bristles 6 in place in the interior of the body 1', when the bristles are glued in place, rather than being pre-glued to form a removable bristle pack.

When the bristles 6 are in the form of a removable bristle pack, and a separator 20 is included, the one end of the bristles 6 and separator 20 can be glued separately, the glue first being allowed to set to form a separate removable bristle pack, and the glued end of the bristle pack then being inserted into the interior of the holder 12 and held in place by the panels 2.

Figure 11:
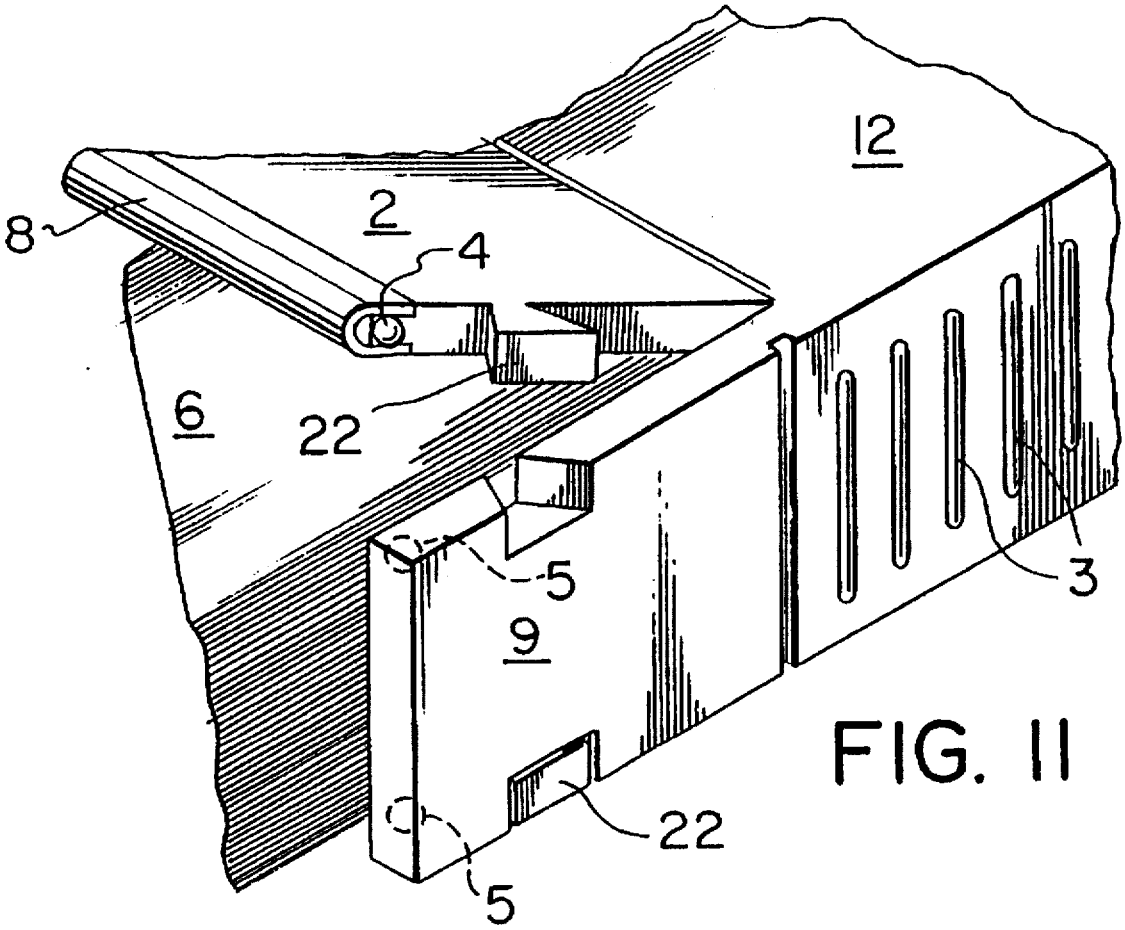
FIG. 11 illustrates an isometric view of the paint brush and bristle gripping panel showing the resilient securing means on the edge of the panel.

FIG. 11 illustrates an isometric view of an alternative embodiment of brush wherein the separator 20 is optional. In this case, the separator 20 does not have to be present as part of the paint brush and bristle holder 12. If the separator 20 is absent, wedges 22 can be formed in the ends of the side panels 2, which are adapted to mate with corresponding wedge-shaped recesses in the sides of end flaps 9, thereby enabling the side panels 2 to unite with the end flaps 9, when the side panels 2 are moved into abutting relationship with the flaps 9. This arrangement holds everything together.

FIG. 11 also illustrates the optional resilient projection or knob 4 located at the corner edge of the side panel 2. This optional projection or knob 4 fits into corresponding depression 5 (shown in dotted lines) formed on the proximate interior of the end flap 9. The side panels 2 (one is shown in FIG. 11) can be moved into a closed position by pressing the knobs 4 into the respective depression 5 inwardly to thereby close the side panels 2 and hold them securely against a mid-point "paint stop-line" on the bristles 6. In this position, they can withstand the force exerted by swelling bristles 6 due to solvent absorption. A strong inward restraining force is exerted against the bristles 6. To open the side panels 2 away from the bristles 6, the paint brush user simply pulls the clips 8 and panels 2 outwardly, whereupon the resilient projections or knobs 4 snap free from the depressions 5, and the side panels 2 can be moved to a non-bristle abutting position suitable for ready cleaning of the bristles 6, or removal of the bristles 6 as a pack, if the bristles come in a removable pack form.

In one alternative embodiment, the paint brush, except for the bristles, can be constructed in one piece. This can be done by economically injection molding the brush, body and handle in one piece, thereby eliminating the need to have a separate ferrule and a separate handle. In this version, the brush can be economical and simple to produce in mass quantities.

Figure 12:
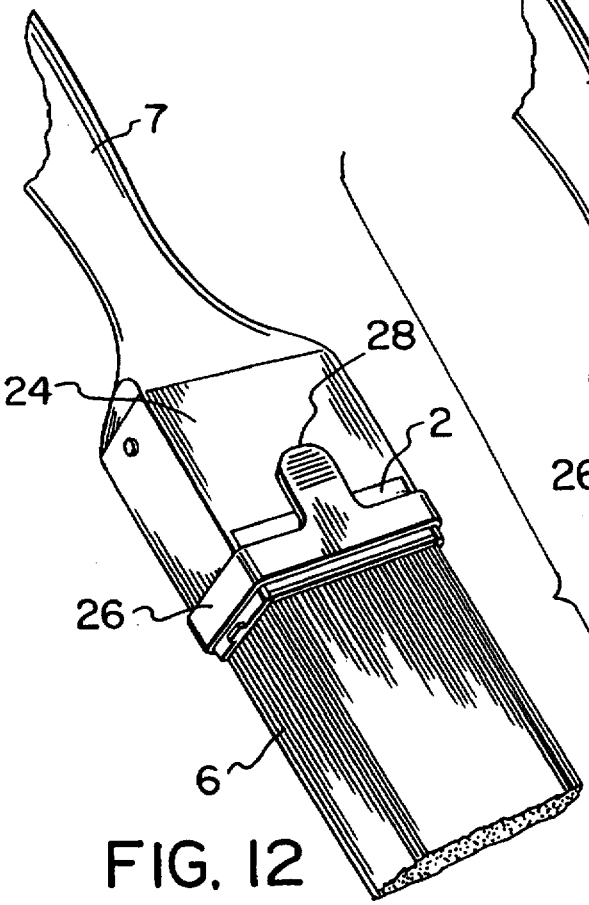
FIG. 12 illustrates an isometric view of an alternative embodiment of paint brush with bristle holder and slidable panel clamp.

FIG. 12 illustrates an isometric view of a further alternative embodiment of paint brush and removable bristle pack. In this embodiment, the base 24 of the brush has a slidable ring 26 around the circumference of the base. In a lower position, as seen in FIG. 12, the ring 26 holds the side panel 2 in a closed position so that it abuts a mid-point "paint stop-line" on the bristles 6. The ring 26 has thereon a tab 28 which assists the user in raising or lowering the ring 26 on the base 24. It also acts as a means of holding the ring 26 in either a raised or lowered position as explained below.

Figure 13:
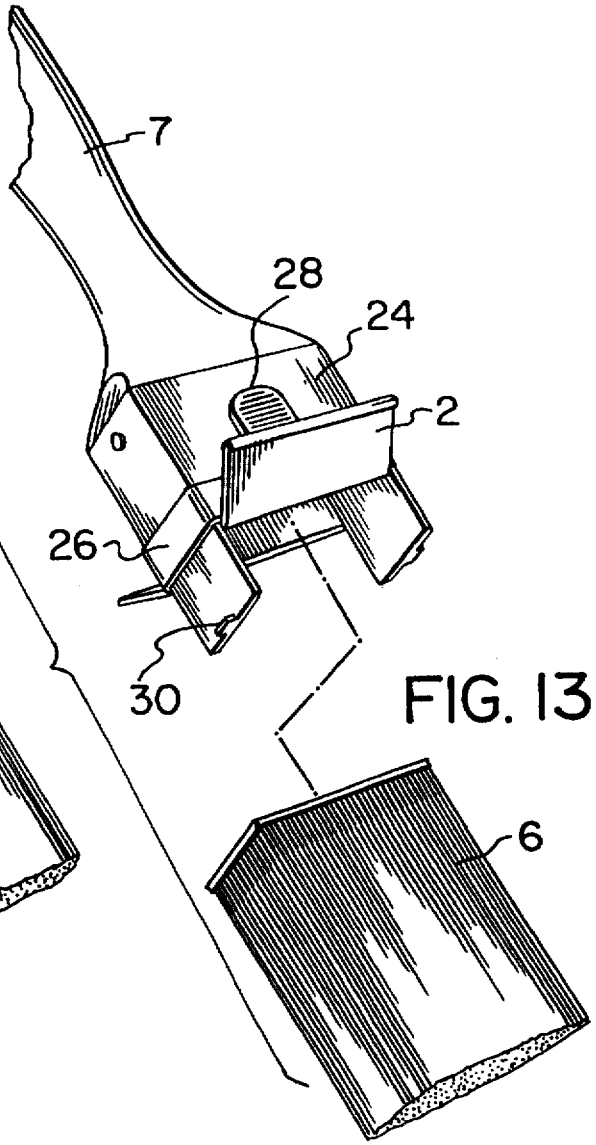
FIG. 13 illustrates an exploded isometric view of the alternative embodiment of paint brush with slidable bristle clamp in open position and bristle pack removed.

FIG. 13 illustrates an isometric partially exploded view of the alternative embodiment of paint brush illustrated in FIG. 12. As seen in FIG. 13, the ring 26 has been slid upwardly on the base 24 so that the side panel 2 can be raised away from the bristles 6. If desired, the embodiment illustrated in FIGS. 12 and 13 can include either a side panel or two opposite side panels 2. With the panels 2 raised, the bristles 6 have been withdrawn from the interior of the base 24 for ready cleaning. The base 24 includes stops 30 which prevent the ring 26 from being withdrawn off the free ends base 24. The ridge created by the interior edge of the clips 19 forms a focused force paint stop line by abutting a mid-point of the bristles 6 across their width.

Figure 14A:
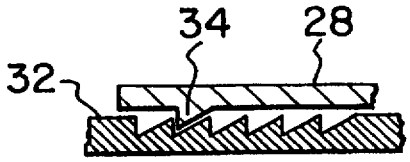
FIGS. 14A and 14B illustrate a detailed section view of two alternative configurations of grooves which can be formed in the sides of the ferrule to hold the slidable panel clamping ring in either an upward or downward position.
Figure 14B:
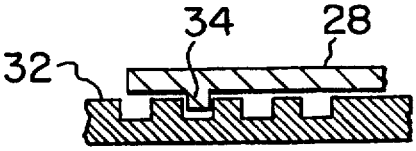

FIG. 14A and 14B illustrate a detailed section view of two alternative configurations of stop grooves (A and B) which can be formed in the sides of the ferrule or body 24 to hold the slidable ring 26 in an upward or downward position. The ring 26 will remain in a lower position (as seen in FIG. 12) when the paint brush is being used for painting. The ring 26 will be in an upper position (as seen in FIG. 13) when the paint brush is being cleaned. When the brush is being used actively in an inverted position in painting walls or ceilings, there will be a tendency for the ring 26 to creep upwardly on the base 24 towards the handle. To prevent this creeping action, the tab 28 has a grip tooth 34 formed on its underside. The side of the brush base 24 has a corresponding mating series of grooves 32 formed therein. Two possible tooth and groove arrangements are shown as A and B in FIG. 14. The tooth 34 fits into the appropriate groove 32. The ring 26 is moved upwardly or downwardly by raising the tooth 34 out of the grooves 32.

Figure 15:
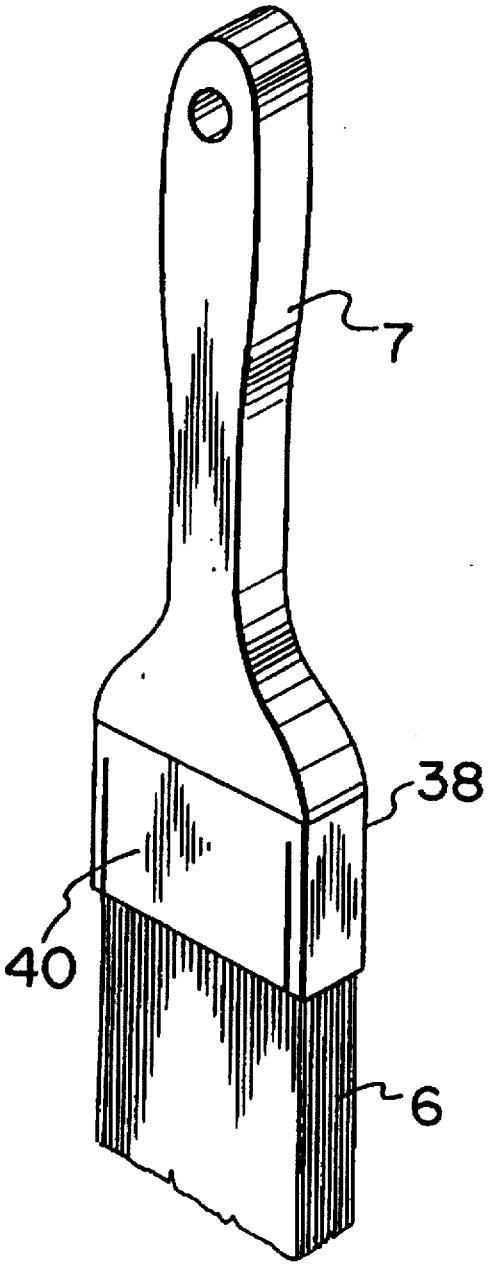
FIG. 15 illustrates an isometric view of an alternative embodiment of paint brush with removable bristle pack and resilient bristle clamping panels.
Figure 16:
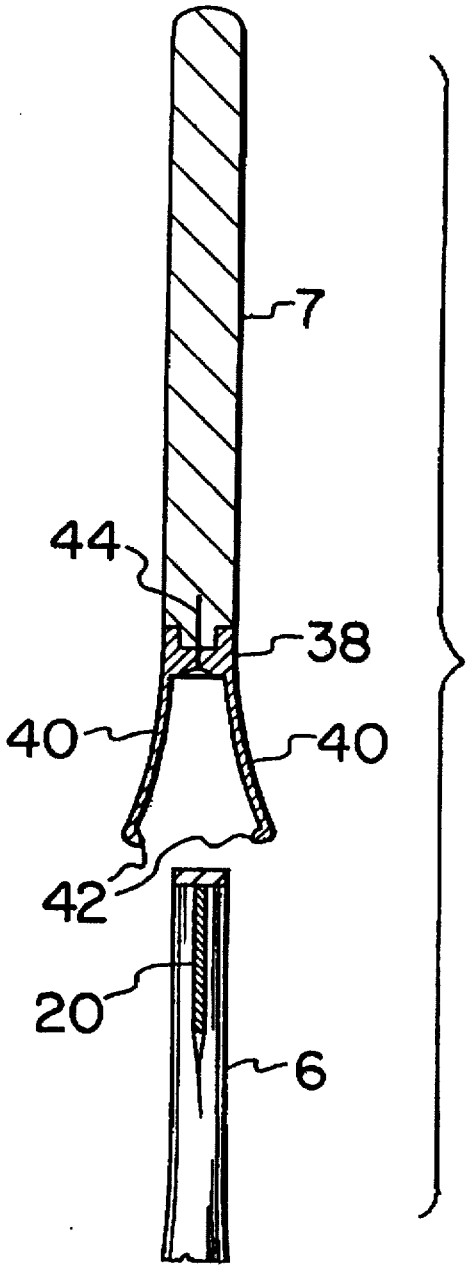
FIG. 16 illustrates a side-section view of the paint brush embodiment illustrated in FIG. 15.

FIG. 15 illustrates an isometric view of a further alternative embodiment of paint brush with removable bristle pack, with resilient spring action side panels 40. FIG. 16 illustrates a side-section view of the paint brush embodiment illustrated in FIG. 15, with the bristle pack 6 partially removed. As seen in FIG. 15, the handle 7 has on the base end thereof a resilient material bristle holder 38, which encloses the base end of the bristles 6. The side flaps 40 (one or two) formed in the holder 38, due to the resilient construction of the holder 38, can be pulled away from the removable bristle pack 6, as seen in FIG. 16 in side section view. In FIGS. 15 and 16, two side flaps 40 are shown. However, it will be understood that only one side flap 40 can be used. The two side flaps 40 have ridges 42 on the inside edges thereof to create a focused compression line ("paint stop-line") on the bristles of the bristle pack 6, when the bristle pack 6 is in place in the interior of the holder 38 as seen in FIG. 15. The holder 38 can be held in place on the base of the handle by a screw 44, or some other suitable securing device. A paint bristle separator 20 can also be included in the bristle pack 6.

Figure 17:
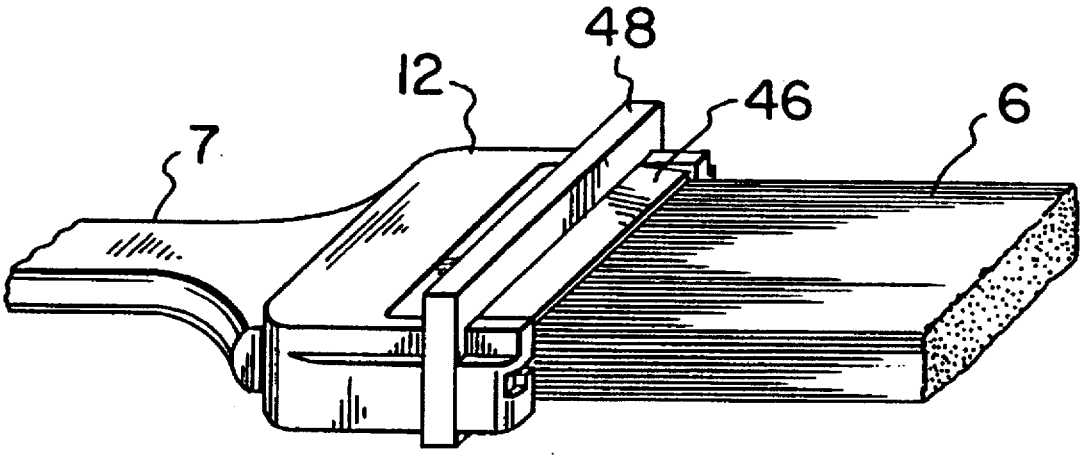
FIG. 17 illustrates an isometric view of a further embodiment of paint brush with raisable bristle panel clamp.
Figure 18:
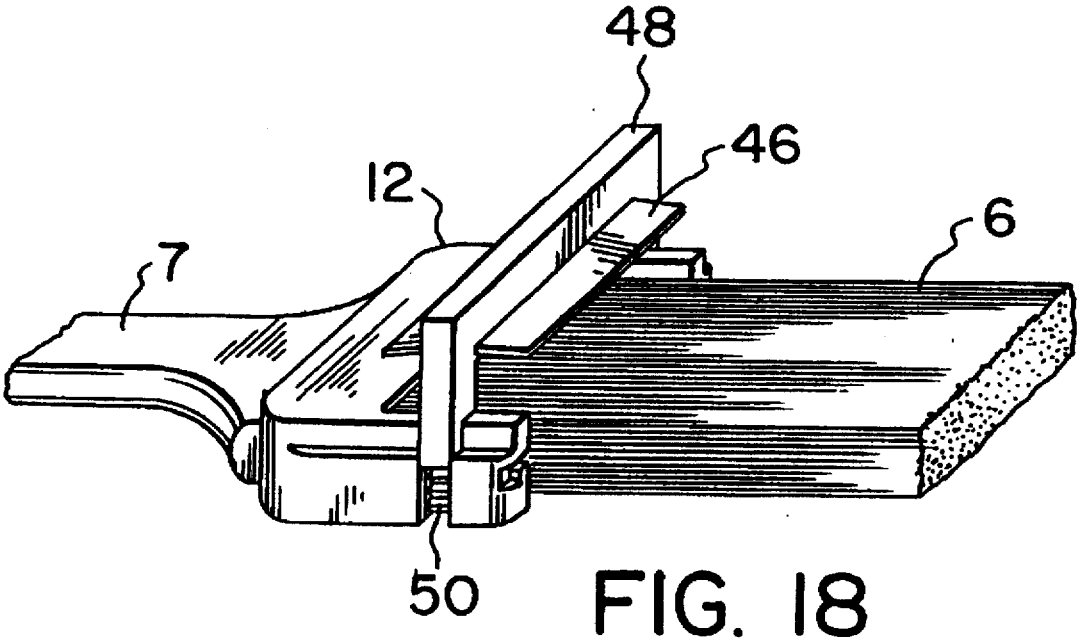
FIG. 18 illustrates an isometric view of the further embodiment of paint brush with the bristle panel clamp raised away from the bristles.

FIG. 17 illustrates an isometric view of a further embodiment of paint brush with a raiseable clamping panel 46. The panel 46 is slideably connected to the holder 12 on either side by a U-shaped bracket 48. The bracket 48 has teeth (not shown) on the inside of each wing which slideably mate with teeth 50 formed in the sides of holder 12 (see FIG. 18). FIG. 18 illustrates an isometric view of the paint brush with the clamping panel 46 in raised non-bristle contacting position. The teeth 50 in the side of holder 12 are visible. These teeth can be of the same design as illustrated in FIG. 14, or of a different suitable design. When the compression panel 46 is in lowered position as shown in FIG. 17, a force is applied to the bristles 6 to create the "paint stop-line" on the bristles.

Figure 19:
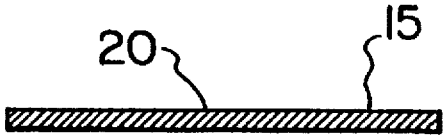
FIG. 19 illustrates a side view of a flat even thickness bristle separator.
Figure 20:
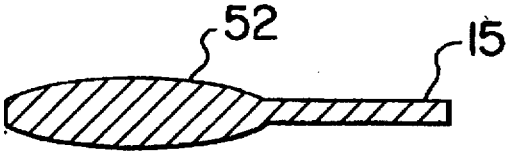
FIG. 20 illustrates a side view of an alternative embodiment of bristle separator with thick mid-section.

FIG. 19, shown on the same sheet of drawings as FIGS. 9 and 10, illustrates a side view of a flat even thickness separator 20 with uniform cross-section, and openings 15 at one end for the glue. FIG. 20 illustrates a side view of an alternative embodiment of bristle separator 52 with a thickened rounded mid-section. This design of separator may be used in cases where it is desired to exert more clamping force ("paint stop-line") on the bristles 6.

Figure 21:
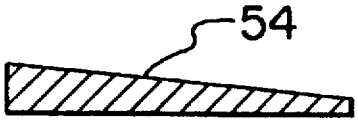
FIG. 21 illustrates a side view of a tapered thickness separator.
Figure 22:
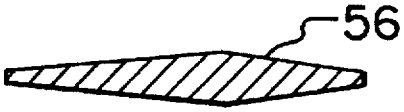
FIG. 22 illustrates a side view of a double tapered thickness separator with thick mid-section.
Figure 23:
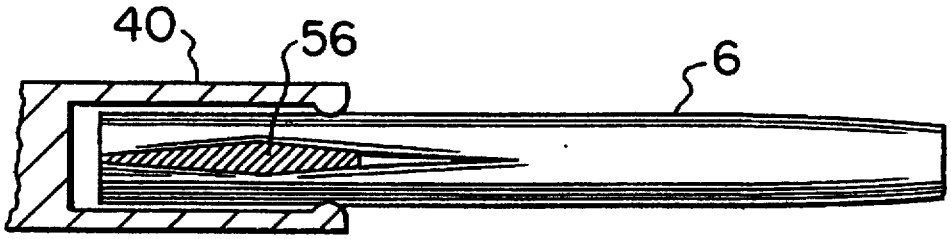
FIG. 23 illustrates a side section view of a bristle holder and removable bristle pack with double tapered thickness separator in the middle of the bristles.

FIG. 21 illustrates a side view of a tapered thickness separator. FIG. 22 illustrates a side view of a double tapered thickness separator with thick midsection. FIG. 23 illustrates a side section view of a bristle holder and removable bristle pack with double tapered thickness separator in the middle of the bristles.

The tapered separator 54 illustrated in FIG. 21 is used in situations where it is desired to apply a tapered configuration to the bristles. The tapered thick mid-section separator 56 illustrated in FIG. 22 is used to apply a force on the bristles which persuades the bristles to form a nice tip at the free end. This action is illustrated in FIG. 23, in exaggerated form. The interior edges 42 of the panels 40 apply an inward force on the bristles which gives them a tapered configuration. This design of separator 56 helps to prevent the development of the common phenomenon of "fish mouth" in conventional paint brushes. In conventional paint brushes, the bristles at the free end are inclined after use to separate from one another in a perimeter fashion leaving an opening ("fish mouth") in the center of the bristles.

Figure 24:
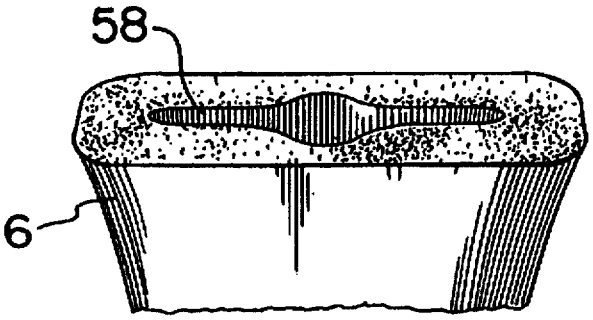
FIG. 24 illustrates an isometric view of the free end of a pack of bristles, with a "fish mouth" opening in the end of the bristles.

FIG. 24, shown on the same sheet as FIGS. 1, 2 and 3, illustrates the "fish mouth" 58 phenomenon, which is particularly prevalent with synthetic bristles.

A major advantage of all versions of the brush disclosed and claimed herein is that when the pair of side panels 2 are forced against the bristles 6 by moving the panels into a closed position, with or without the optional knobs 4 received in the recesses 5, the solid paint particles in the paint emulsion coating the bristles 6 are prevented by the free interior edges of the panels 2, and the ridges thereon, from migrating along the bristles past the free edges of the panels 2 or the reinforcing U-clip edges 8, into the interior of the bristle holder. The edges and internal ridges of the panels 2, as explained previously, create a "paint stop-line" on the bristles 6. While the liquid carrier medium of the liquid solids paint emulsion may migrate by capillary action along the bristles 6, and past the free leading edges of the pair of panels 2, the solids in the emulsion are effectively stopped at the point of pressure under the leading ridge edge of the pair of U clips 8, creating a "paint stop-line". A liquid-solid separation therefore takes place in the region of each panel 2 and U-clip 8. When it is time to clean the paint brush, the pair of side panels 2 are pulled away from the bristles 6, and areas of bristles which have not been coated with solid paint are exposed for enabling a paint solvent to attack and dissolve paint on the bristles from all sides. The interrupted paint solids are openly exposed on the bristles 6, at an intermediate point, and are not thus accumulated in a difficult to clean position against the holder or base of the bristles. For additional convenience and cleaning efficiency, the bristles 6 can be removed as a pack as shown in FIG. 13. The solvent can be either a petroleum distillate, which is normally used for cleaning oil-based paint brushes, or water, which is used to remove water soluble latex-based paints.

Tests which have been conducted with prototypes of the invention indicate that the bristles 6 can be completely cleaned using only about 20 to 50 percent less water or solvent that is normally used to clean a conventional paint brush. Much of the solvent in a conventional case is consumed by endeavouring to clean away the collected, coagulated and dried paint solids, which typically form and collect at the base of the bristles, where they join the ferrule in a conventional paint brush. Another advantage of the paint brush design, with the moveable side panels 2 is that the paint particles are prevented from contacting the junctions where the bristles meet the brush handle, or ferrule, where they tend to dry and stiffen. The dried paint causes flex points which force the bristles to bend at those points, eventually leading to breakage of the bristles.

Because there is no build-up of paint solids within the bristles 6, in the cleanable bristle pack design especially, the region where the bristles 6 are set into the interior of the body 1 remains clear and flexible, and accordingly bristle flare and bristle wear are avoided or minimized. A long-standing problem with conventional paint brushes is that the performance of the paint brush is proportionately reduced with the build-up of clogged dry paint at the base regions of the bristles. This does not occur in the applicant's paint brush construction because the panels 2 can be moved away from the bristles 6 to expose the bristles for ready cleaning. It is only when the paint brush is being used that the panels 2 are first pivoted against the bristles 6 by the panels 2 into a closed position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paint brush comprising:

(a) a group of bristles;

(b) a paint brush body with a handle at one end, and a cavity formed in the opposite end for releasably holding in said cavity one end of said group of bristles;

(c) a moveable member with an edge thereof associated with a side of the body, said moveable member projecting over the cavity, and being capable of abutting a mid-point on the side of said group of bristles when moved to a closed position, to thereby apply a holding force on said group of bristles and create a paint stop line at a mid-point on the side of said group of bristles, said holding force being released when said moveable member is moved to an open position, away from the side of said group of bristles;

wherein said moveable member has projections on unsecured ends thereof for releasably engaging complementary depressions in said body for securing said moveable member in said closed position and disengaging said projections from said depressions releases said moveable member to allow movement of said moveable member to said open position;

wherein the projections are semi-spherical knobs on said unsecured ends of said moveable member and said depressions are semi-spherical hollows in end flaps in the body adjacent the positions of said knobs when said moveable member is in said closed position.

2. The paint brush of claim 1 further comprising a second moveable member like the moveable member claimed in claim 15, wherein said two moveable members are associated with opposite sides of said body and both moveable members have semi-spherical knobs on unsecured ends of said two moveable members for engaging respective complementary depressions in said body for securing said moveable members in said closed position.

3. The paint brush of claim 2 further comprising a removable bristle separator located in said cavity between said pair of moveable members.

4. The paint brush of claim 3 wherein the removable bristle separator is secured to end walls of said cavity in said body.

5. The paint brush of claim 3 wherein said separator is thin at each end and has a thickened mid-section.

6. The paint brush of claim 3 wherein said separator is planar and as a uniform cross-section.

7. The paint brush of claim 3 wherein said separator has a tapered thickness from a first end to a second end.

8. The paint brush of claim 1 wherein bristles belonging to said group of bristles are secured together at one end by glue, said glued end fitting in the interior of said cavity.

* * * * *